United States Patent [19]

VerShaw et al.

[11] Patent Number: 4,830,600

[45] Date of Patent: May 16, 1989

[54] PREMIX FURNACE BURNER

[75] Inventors: James T. VerShaw, La Crosse, Wis.; John A. Beasley, Clarksville, Tenn.

[73] Assignee: American Standard Inc., New York, N.Y.

[21] Appl. No.: 145,026

[22] Filed: Jan. 19, 1988

[51] Int. Cl.[4] ..... F23C 5/00

[52] U.S. Cl. ..... 431/8; 431/328; 431/354; 126/91 A

[58] Field of Search ..... 431/354, 328, 329, 284, 431/348, 349, 350, 114; 126/92 R, 92 AC, 92 B, 91 R

[56] References Cited

U.S. PATENT DOCUMENTS

| | | | |
|---|---|---|---|
| 1,458,266 | 6/1923 | Breeding | 431/8 |
| 1,687,983 | 10/1928 | Klees et al. | 126/110 R |
| 3,042,020 | 7/1962 | Maurice | 126/110 R |
| 3,625,495 | 12/1971 | Harter | 432/223 |
| 3,936,003 | 2/1976 | Hapgood et al. | 239/559 |
| 4,243,176 | 1/1981 | Hays | 237/7 |
| 4,323,343 | 4/1982 | Reed et al. | 431/202 |
| 4,329,138 | 5/1982 | Riordan | 431/90 |
| 4,334,855 | 6/1982 | Nelson | 431/20 |
| 4,340,355 | 7/1982 | Nelson et al. | 431/20 |
| 4,397,631 | 8/1983 | Fisher | 431/328 |
| 4,424,793 | 1/1984 | Cooperrider | 126/110 B |
| 4,460,329 | 7/1984 | Trent | 431/20 |
| 4,465,456 | 8/1984 | Hynek et al. | 431/62 |

FOREIGN PATENT DOCUMENTS

| | | | |
|---|---|---|---|
| 36340 | 3/1977 | Japan | 431/328 |

*Primary Examiner*—James C. Yeung

*Attorney, Agent, or Firm*—William J. Beres; David L. Polsley; Robert J. Harter

[57] ABSTRACT

A premix furnace burner for a gas combusting furnace. The furnace burner includes a premix chamber and a burner plate assembly. The burner plate assembly is comprised of a burner plate with a plurality of relatively small apertures for the passage of a mixture of combustible gas and air and an annular ring for retaining the burner plate. The annular retaining ring determines the capacity of the furnace burner by appropriately sizing of the opening in the annulus of the retaining ring to sealingly overlay a selected portion of the burner plate apertures. The retaining ring further secures the burner plate in the correct operational position while simultaneously permitting the burner plate to expand and contract in response to temperature changes induced by combustion of the gas and air mixture. The premix chamber includes therein a blower impeller driven by a two-speed motor and a control means for selectively operating the impeller at a relatively higher or lower speed to vary the rate of flow of the mixture of combustible gas and air and thereby vary the firing rate of the furnace.

10 Claims, 3 Drawing Sheets

FIG. 1
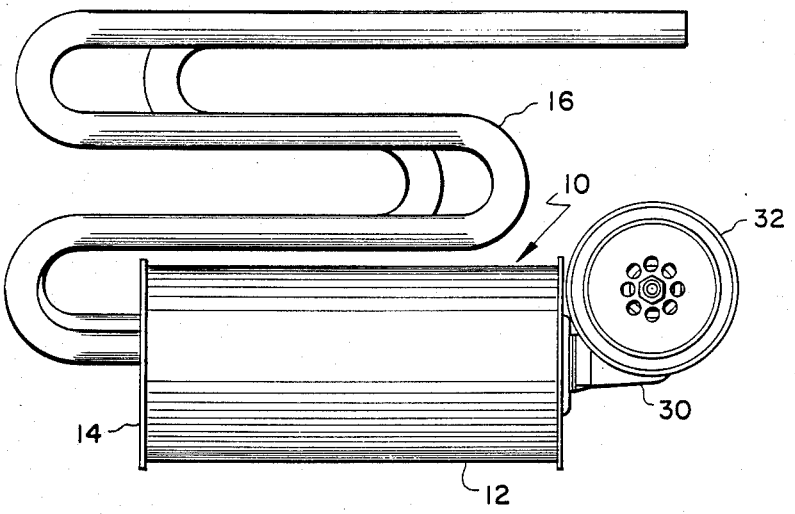
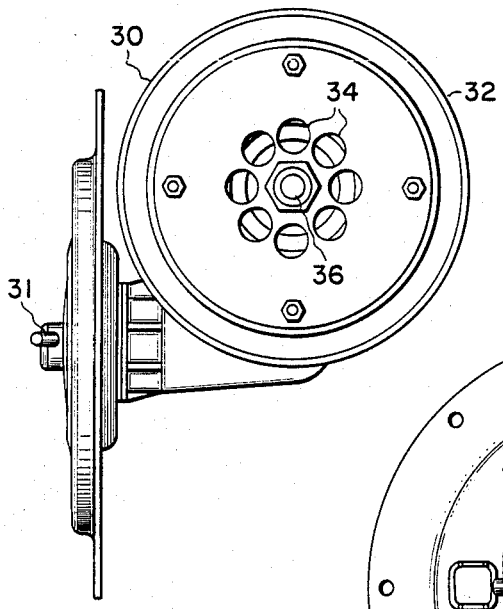
FIG. 2
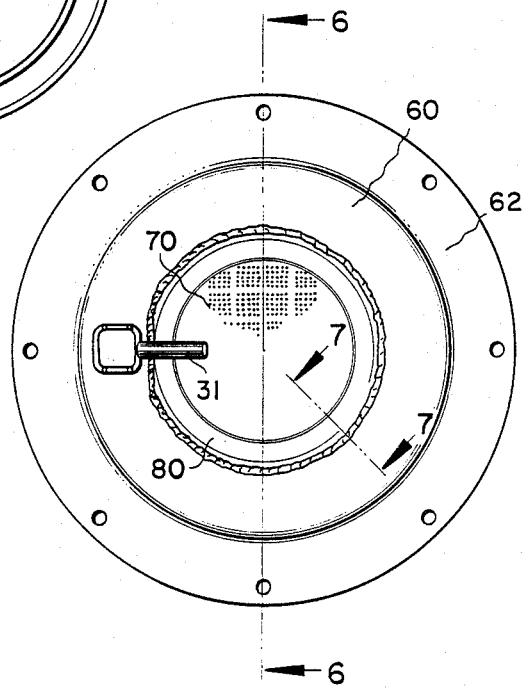
FIG. 5

FIG. 6
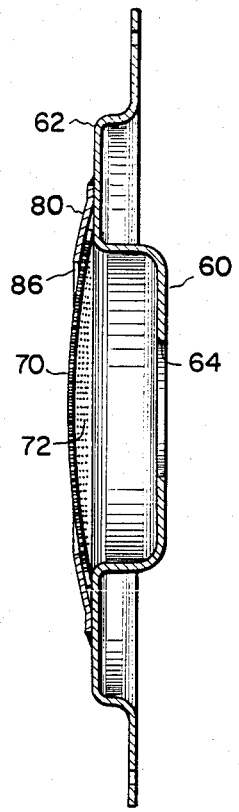
FIG. 7
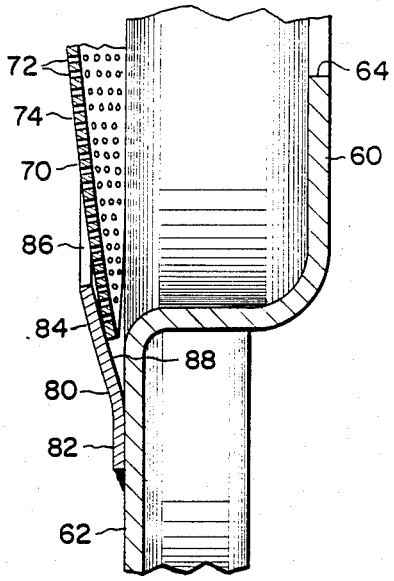
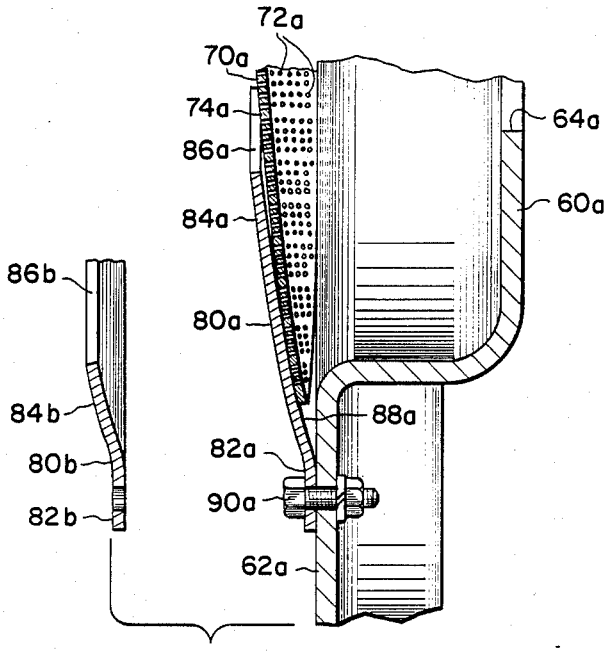
FIG. 8

PREMIX FURNACE BURNER

TECHNICAL FIELD

This invention generally pertains to a furnace burner for a gas combusting furnace and more specifically to a variable rate premix furnace burner having a heating capacity modulated by use of a multiple-speed motor and by a burner plate having a plurality of relatively small apertures with an annular retaining ring sealingly overlying a selected portion of the apertures to limit the flow through said apertures.

BACKGROUND ART

A typical gas combusting furnace useful for space heating includes a furnace burner for generating heat, means for exchanging the heat from the burner to the heated space, and means for controlling the operation of the burner. The typical furnace burner of the premix type related to the subject invention includes a chamber wherein gas and air are mixed and then forced by a single speed, motor operated blower to a combustion chamber. In a typical premix type furnace burner, the mixture of gas and air is directed into the combustion chamber through a burner element such as a burner plate having a plurality of relatively small apertures.

In a typical gas combusting furnace utilizing a burner plate, the means for securing the burner plate commonly includes the use of screws or bolts, for example. In order to accommodate thermal expansion of the burner plate, it is often found necessary to leave the screws or bolts slightly loose, while providing enlarged or elongate holes in the burner plate for the screws or bolts to permit movement of the burner plate. When the burner plate is thus loosely secured, vibration of the burner plate and noise are often observed. It is also possible for a portion of the mixture of gas and air to enter the combustion chamber around the perimeter of the burner plate, thereby escaping combustion or being combusted outside the central flame zone at a relatively lower temperature, thus reducing the efficiency of the furnace.

A gasket may be provided adjacent the burner plate to attempt better control of the flow of gas and air, however, means for gasketing the burner plate generally prove to be prone to failure due to the temperatures encountered in combustion.

Some designs of burner plates seek to eliminate the undesirable flow of gas around the perimeter of the burner plate by providing a concave burner plate which, when thermally expanded, tends to increase in concavity and thus wedge against the securing screws or bolts. This solution is found to provide better control of combustible gas at the expense of increased stress and fatigue of the securing screws or blots and of the burner plate.

Another typical alternative design is to secure the burner plate in the furnace burner in a fixed manner, such as by welding, and thereby ignore the effects of thermal expansion. Designs of this type, while reducing objectionable vibration and noise, typically suffer from increased stress and fatigue of the furnace burner components, with concomitantly higher failure rates.

Previous designs of furnace burners have been typified by the requirement of a furnace burner uniquely sized to produce each furnace firing capacity. This is accomplished by the sizing of a blower and burner plate to achieve the desired firing capacity. The remaining components of the furnace burner must also be sized to accommodate the selected burner plate and blower. For each different firing rate, a furnace burner of the appropriate size, with all the appropriate components, is required. This results in undue multiplicity of components, and additionally makes difficult the stocking and servicing of furnace burners with correct components.

Typically, the furnace burner is operated intermittently when the furnace control means senses a requirement for additional heat in the heated space, based upon the tmeperature measured in that space. This heat requirement varies according to the season and climactic conditions, and the furnace operates as necessary to provide the heat required. The typical method of responding to these changes in heating demand is to change the duration of the operation of the furnace burner, or firings, and the interval between the firings. Thus, it is often found that the burner is operated for short perids of time during low heating requirement periods. This is inefficient and wasteful of fuel, since much of the heat generated is wasted in reheating the furnace components. An alternative method is to provide longer firings with increased intervals between the firings, which results in undesirable fluctuations between minimum and maximum temperatures found in the heated space.

Another alternative lies in reducing the gas input to the burner to provide a relatively lower heat output of the furnace in response to a lower heat requirement and thereby maintain the heat exchanger efficiency. However, changing the gas input rate without changing the corresponding air input rate changes the air to fuel ratio, causing improper combustion and substantially lowered efficiency of the furnace burner. Several patents have issued to address the problems inherent in typical premix furnace burners.

U.S. Pat. No. 4,465,546 discloses a variable rate burner having a throttle plate which is opened and closed to admit more or less air and gas for combustion. A multiple speed blower is not taught in the patent.

A variable rate gun type burner is disclosed in U.S. Pat. No. 4,424,793. The blower is driven by a single speed motor through a variable speed drive to supply air at a variable rate to the combustion chamber.

U.S. Pat. Nos. 4,334,885 and 4,340,355 teach the use of an induced draft apparatus having a variable speed blower in the exhaust of the combustion chamber. As in the foregoing patent, mixing of gas and air occurs at the point of combustion, and the blower acts only upon the air velocity through the furnace burner.

U.S. Pat. No. 4,480,629 discloses a burner with a plurality of small ports in a planar burner plate which is firmly secured to a header. No provision is made for thermal expansion or for interchangeability and standardization of the burner.

U.S. Pat. No. 4,397,631 teaches the use of an annular perforated burner which is domed to permit thermal expansion to cause co-axial movement of the burner. In the event of irregular circularity of the burner or housing, gas may bypass the burner causing incomplete combustion. This burner is relatively complex in design and does not permit interchangeability or standardization of furnace burner components.

A burner having a single port is disclosed in U.S. Pat. No. 2,162,084. A plenum with air admitting perforations is disposed adjacent to the burner. A retainer secures the burner assembly. No teaching or suggestion as to interchangeability or standardization of the burner components is found in the patent, nor does the teaching of the patent include any suggestion of modulation of heating capacity.

In consideration of the foregoing, it is an object of the present invention to provide modulation of the heating output in a premixing type furnace burner.

It is a further object to provide a furnace burner with superior means for directing and controlling the flow of combustible gas and air.

Another object of the invention is to provide a means for retaining a burner plate in a furnace burner while readily accommodating thermal expansion of the burner plate.

A still further object is to provide a furnace burner with components of a standard size.

Yet a still further object is to provide a furnace burner with a readily selectable firing capacity.

A still further object is to provide the foregoing in the simplest and most cost-effective manner.

These and other objects of the invention will be apparent from the attached drawings and the description of the preferred embodiment that follows hereinbelow.

SUMMARY OF THE INVENTION

The subject invention is a premix furace burner for a gas combusting furnace, comprised of a premix chamber, a blower for forcing a mixture of air and gas from the premix chamber, and a burner plate assembly. The blower is driven by a motor having selectable multiple speeds. This motor may have, in alternative embodiments, two discrete rotational speeds, more than two discrete rotational speeds or an infinite range of speeds between a relatively higher speed and a relatively lower speed.

The burner plate assemby includes a burner plate with a plurality of apertures permitting the passage of the premixed gas and air mixture from the premix chamber to a combustion chamber. The burner plate is locationally secured by an annular retaining ring extending about and sealingly overlying a selected portion of the burner plate. The retaining ring is sized to permit thermal expansion of the burner plate, and the interior opening of the annulus of the retaining ring is sized to overlay a selected number of apertures in the burner plate, and thereby obtain a selected firing capacity of the furnace burner. In order to change the firing capacity of the burner plate assembly, it is necessary only to secure the burner plate with a retaining means having an opening of a different size through the annulus interior to overlie and sealingly cover a selected portion of the apertures of the burner plate.

BRIEF DESCRIPTION OF THE DRAWINGS

FIG. 1 shows a premix furnace burner disposed in a furnace heat exchanger assembly.

FIG. 2 shows the premix furnace burner in greater detail.

FIG. 5 shows a frontal view of the burner plate assembly of the premix furnace burner.

FIG. 6 shows a cross-sectional view of the premix furnace burner taken through line 6—6 of FIG. 5.

FIG. 7 shows an enlarged cross-sectional view of the premix furnace burner taken through line 7—7 of FIG. 5.

FIG. 8 shows an enlarged cross-sectional view of an alternative embodiment of the premix furnace burner taken through line 7—7 of FIG. 5.

DESCRIPTION OF THE PREFERRED EMBODIMENT

Figure 4:
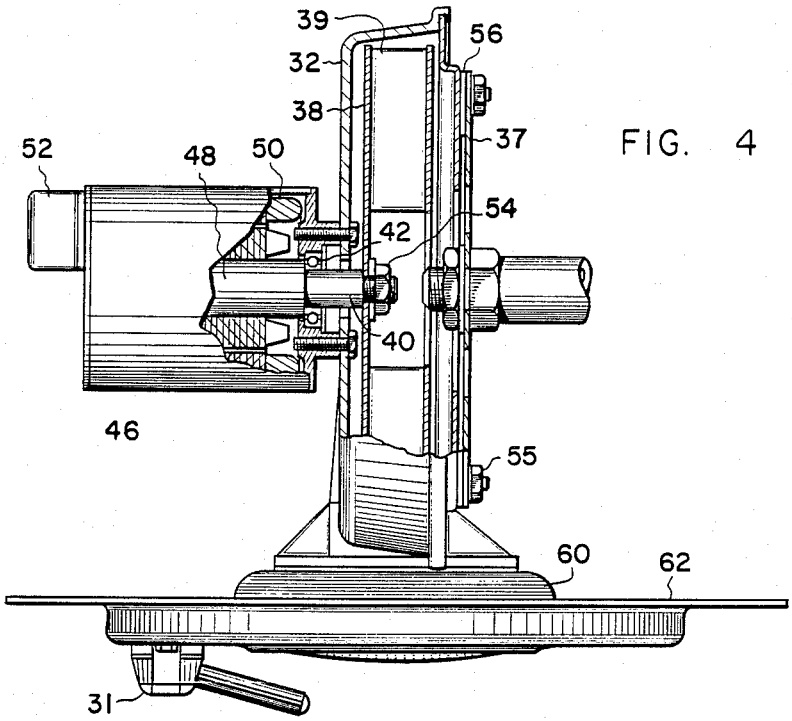
FIG. 4 shows another partial cross-sectional view taken through the motor and premix chamber housing of the premix furnace burner.

A furnace heat exchanger assembly generally denoted by reference numeral 10 is shown in FIG. 1. The furnace heat exchanger assembly 10 includes a drum 12 defining a combustion chamber, an end plate 14 sealingly secured to the distal end of the drum 12, and a number of heat exchange tubes 16 secured to end plate 14. The heat exchange tube 16 are in flow communication through apertures (not shown) in end plate 14.

A furnace burner assembly 30 is sealingly secured to the proximate end of the drum 12 for admitting a combustible gaseous mixture to the combustion chamber defined by drum 12. Preferably, the furnace burner assembly 30 is vertically disposed to prevent blockage by debris or foreign matter which may be present, although the furnace burner assembly 30 would work equally well if horizontally disposed for downward firing.

In operation, a combustible gas and air are mixed in the furance burner and forceably directed into the combustion chamber of the drum 12, wherein they are ignited to cause combustion of the gas and air mixture. The heat thus released is transferred to the space about the heat exchanger assembly 10 while the combustion by-products are simultaneously exhausted from the combustion chamber through the heat exchanger tubes 16.

The heated gaseous by-product of combustion is directed through the heat exchange tube 16, which are heated thereby, causing further heat transfer to the space about the furnace heat exchange assembly 10.

It is to be understood that the foregoing description of the furnace heat exchanger assembly is intended to clarify the placement and use envisioned for the preferred embodiment of the furnace burner, and is not to be understood as limiting. Other combinations of combustion chambers, heat exchange tube arrangements, and ignitors would work equally well.

FIG. 2 shows an enlarged view of the furnace burner assembly separate from the heat exchanger assembly 10. The end of the furnace burner assembly 30 which is normally disposed within the drum 12 has an ignitor 31 mounted thereon to ignite the mixture of gas and air flowing into the drum 12. A premixing chamber housing 32 includes a plurality of air intake apertures 34 arranged about an inlet 36 for combustible gas on an inlet plate 37. Eight air intake apertures 34 are shown in FIG. 2.

Figure 3:
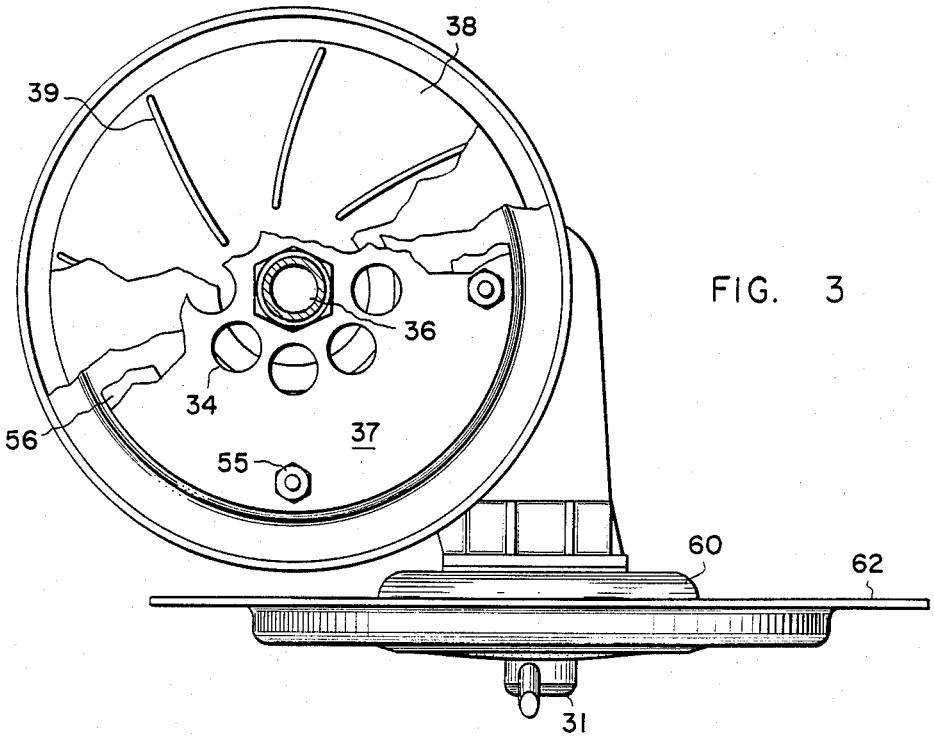
FIG. 3 shows a partial cross-sectional side view of the premix chamber housing of the premix furnace burner.

FIG. 3 shows in partial cut away view the disposition of a centrifugal fan impeller 38 with forward inclined vanes 39. The impeller 38 is rotatably disposed within the housing 32 adjacent the air intake 34 and the gas inlet 36. The gas inlet 36 is centrally located with respect to the housing 12 and the air intakes 34 are located generally in a circle around the gas inlet 36.

The preferred embodiment of the furnace burner in the subject invention is set forth more clearly in FIG. 4. A centrifugal fan impeller 38 is disposed on shaft 40, which is rotatably mounted in bearings 42. The fan shaft 40 is driveably connected to a motor 46. The motor 46 may be a single speed motor, but preferably is a multiple speed motor.

Referring generally now to FIGS. 2 through 5, the motor 46 is disposed upon premix chamber housing 32 and includes a rotor portion 48 of shaft 40, a stator 50, and an electronic speed control and starter device 52. A nut 54 on a threaded distal end of shaft 40 connects rotor 48 and impeller 38 in a driving relationship. The motor 46 is disclosed in general for descriptive purposes, as the state of the art for electrically driven motors with multiple selectable speeds is believed to be generally well understood. In the preferred embodiment, however, a two-speed motor is used. It is also to be understood that the furnace burner assembly 30 is described as the preferred embodiment, and is not to be taken as a limitation upon the application of the subject invention.

The inlet plate 37 is secured to the premix chamber housing 32 by bolts 55, with a gasket 56 sealingly interposed between the inlet plate 37 and the housing 32.

The premix chamber housing 32 is connected by duct 58 to a plenum formed by a header portion 60 of a mounting base 62. The mounting base 62 is secured to the combustion drum 12 in a sealing manner at the proximate end of the drum 12. A feed aperture 64 is centrally disposed within the header 60 of mounting base 62, thereby permitting the combustible gas mixture to pass in flow communication from the duct 58 and through the header 60 into the combustion chamber of the drum 12.

A burner plate 70 is disposed across and about the feed aperture 64 in mounting base 62. In the preferred embodiment, the burner plate 70 is perforated through with a plurality of 0.027 inch diameter apertures 72 in a line pattern spaced at 400 holes per square inch, with every 6th row and 6th column having no apertures therein and being a solid portion of the burner plate 70. This corresponds to a pattern wherein the burner plate apertures 72 are separated by a solid burner plate portion substantially equal in width to the diameter of a burner plate aperture 72. The width of the row and column portions is substantially equal to 3 times the diameter of a burner plate aperture 72. Testing has shown that aperture sizes between 0.025 inches and 0.030 inches in diameter are acceptable, whereas larger apertures tend to produce unacceptable high frequency noise. It has also been found that the row and column pattern in the preferred embodiment provides greater flame stability than other patterns such as random placement or staggered placement of the apertures 72.

The preferred pattern provides flame stability and reduces the likelihood of a flame out condition. It is understood that while this pattern is used in the preferred embodiment, other patterns and sizes of apertures are equally suitable, and that the preferred pattern is therefore not to be understood by way of limitation. The burner plate 70 in the preferred embodiment is circular and slightly concave with respect to the plenum defined in mounting base 62, with an outer surface 74 disposed toward the combustion chamber of drum 12.

The burner plate 70 is retained positionally by a retainer 80, which is preferably an annular ring, as shown in FIGS. 5 through 8. The annular retainer ring 80 is of one piece design including two portions, one portion being a flat outer ring 82 for secureably mounting to the mounting base 62, and the second portion being an inner concave portion 84 having an inner edge 86 defining an inner diameter cooperating with the burner plate 70. The inner portion 84 of the retaining ring 80 has an inner retaining surface 88 which engages a portion of the burner plate 70, thereby securing the burner plate 70 to the furnace burner assembly 30. The inner surface 88 simultaneously overlays and covers a selected number of apertures 72 in the burner plate 70 to prevent flow through the covered aperture 72. Cooperation of the burner plate 70 and the retainer ring 80 is achieved by providing a fit between the burner plate 70 and the inner concave portion 84 permitting longitudinal sliding engagement of the burner plate 70 with respect to the retainer 80.

In operation, the motor 46 is started by application of electrical current through the speed control and starter device 52 to the rotor 48 and stator 50. This causes rotation of the rotor 48, driving the fan impeller 38 through the shaft 40. The impeller 38 forces air through duct 58 and draws air into premix housing 32 through the air intake apertures 34, purging the drum 12. Combustible gas, which has been regulated to zero pounds per square inch or less pressure, is then drawn by the suction action of impeller 38 through the gas intake 36 and mixed in the premix chamber housing 32 with the air. The resulting combustible mixture is forced through duct 58 to the plenum formed by header 60. From the header 60, the combustible gaseous mixture passes through the aperture 72 in burner plate 70 and into the combustion chamer defined by drum 12 wherein it is ignited by ignitor 31 and combusted. The combustion flame is stabilized aerodynamically immediately adjacent the burner plate 70 by the interaction of the plurality of sustantially small jets of combustible mixture flowing into the drum 12 through the apertures 72. Thus stabilized, the combustion flame is compact, occuring within a short range of distance from the burner plate 70. The combustion flame is also uniform across the burner plate 70, reducing the likelihood of the flame being blown out during firing.

When the motor 46 is operated at a relatively lower speed, the impeller 38 draws relatively less air to the housing 32, and a relatively smaller amount of combustible gas is drawn through inlet 36 and premixed with the air, maintaining an acceptable air/fuel ratio. In the lower speed condition, less combustible gas is burned in a given period of time, resulting in a lower heat output from the combustion chamber and furnace heat exchanger. Conversely, when the motor 46 is operated at the higher speed, a larger amount of combustible gas and air mixture is directed to the combustion chamber and a higher heat output is generated in the combustion chamber and furnace heat exchanger assembly in a given period of time. Thus, with a proper speed control and starter device 52 for motor 46, a furnace with a modulated heat output of higher and lower relative capacities is achieved.

In an alternative embodiment, a motor 46 is used. The motor 46 has a number of discrete rotational speeds including a relatively higher speed, a lower speed, and at least one intermediate speed. A furnace having an intermediate modulated firing rate is achieved by operating the motor 46 at the intermediate speed with the speed control and starter device 52, causing an intermediate air flow and hence an intermediate heat output.

In yet another alternative embodiment, the motor 46 has a higher speed, a relatively lower speed and an infinite range of speeds selectable therebetween. In operation, this alternative embodiment is substantially the same as the preferred embodiment, however, a suitable speed control and starter device 52 is used to selectively modulate the heat output of the furnace by selecting the appropriate rotational speed of the motor 46 between and including the relatively higher and lower speeds of the motor 46.

The firing capacity of furnace burner assembly 30 is expressed in MBH, an abbreviation for Thousands of British Thermal Units produced per hour. Many factors interrelate to determine the firing capacity of a given furnace burner assembly, including without limitation the volumetric ratio of fuel to air and the quality of the fuel. These factors and their interrelation is not set forth in detail, as it is believed that one familiar with the state of the art will readily understand them, and that furher description is not therefore necessary. However, in the preferred embodiment, it is assumed for descriptive purposes that these factors are constants, although they need not be.

In the subject invention, the firing capacity of furnace burner assembly 30 at any given motor 46 speed is determined by the number of apertures 72 available to permit flow communication from the plenum of header 62 to the combustion chamber in drum 12. The number of apertures 72 available is a function of the diameter of the inner opening 86 of retainer ring 80. Those apertures 72 in that portion of burner plate 70 which exceeds in diameter the inner opening 86 are sealingly overlaid and covered by the inner portion 84 of the retainer ring 80. The inner portion 84 thus extends about the periphery of burner plate 70, overlying and preventing flow communication through said apertures 72.

Thus, to obtain a furnace burner assembly 30 of a given firing capacity at a given motor speed, it is necessary only to secure burner plate 70 with a retainer ring 80 having an inner opening 86 of a suitable diameter, for example, 5 inch diameter. If an inner opening 86 of larger diameter is used such as 6 inch diameter, the firing capacity of the furnace is increased, whereas if an inner opening 86 of smaller diameter, such as 4 inch diameter, is used, more apertures 72 are covered and the firing capacity of the furnace burner assembly 30 is thereby decreased.

The firing capacity of a furnace burner assembly 30 is variable from the given firing capacity by changing the speed of the motor 46. The speed of the motor 46 is selectable within a range of speeds corresponding to flow rates of the combustible mixture which maintain acceptable flame stability. This range of acceptable speeds is determined by analysis and empirical testing conducted during the initial design of the furnace burner assembly 30 by methods generally well understood by those familiar with the art.

Turning now to FIG. 6, a cross-sectional view of a furnace burner 30, taken through line 6—6 of FIG. 5, shows a retainer ring 80 welded sealably to a mounting base 62. This embodiment is shown again in greater detail in FIG. 7, which is an enlarged cross-sectional portion of furnace burner 30 taken through line 7—7 of FIG. 5. In this embodiment, the inner opening 86 is of relatively large diameter, overlaying and sealingly covering a relatively small number of apertures 72. The relatively larger number of apertures 72 exposed provides for greater flow communication from the header 60 to the combustion chamber in drum 12 and a higher firing capacity furnace burner assembly 30.

During operation of the furnace burner assembly 30, the combustible mixture exerts pressure on the burner plate 70. This causes the burner plate 70 to be pressed against the retainer ring 80, causing in turn the sealing of those apertures 72 overlaid thereby.

Furthermore, during the operation of the furnace burner assembly 30, the burner plate 70 is heated by the combustion and expands. The expansion of the burner plate 70 manifests itself in increased diameter and increased concavity of the burner plate 70. The increased concavity of the burner plate 70 forces the outer burner surface 74 more firmly against the inner retaining surface 88 of the retainer ring 80, increasing the sealing effect of the retainer ring 80 with respect to the apertures 72 covered and overlaid thereby. The combustible gaseous mixture can therefore only enter the combustion chamber through the apertures 72, which directs the mixture into combustion in the drum. The longitudinal sliding engagement betweeen the burner plate 70 and the retainer ring 80 accommodates the increased diameter and concavity resulting from the thermal expansion of the burner plate 70.

FIG. 8 shows an enlarged cross-sectional portion of an alternative embodiment of the furnace burner assembly **30*a*. Retainer ring 80*a* has a small diameter inner opening 86*a*, thus overlying and covering a relatively large number of apertures 72*a* in burner plate 70*a*. This in turn reduces the number of apertures in flow communication between header 60*a* and the combustion chamber. With the smaller number of available apertures the burner plate 70*a* permits flow of a relatively smaller volume of combustible gas mixture to the combustion chamber and effects a lower firing rate of the furnace burner assembly 30. As in the foregoing embodiments, thermal expansion is accommodated by the expansion of burner plate 70*a* in both diameter and concavity. The slideable engagement of retainer ring 80*a* and the burner plate 70*a* readily permits this thermal exapnsion while preventing locational displacement of burner plate 70*a*. In this embodiment, the firing rate of furnace burner assembly 30*a* is readily changed by replacement of retainer ring 80*a* with an alternate retainer ring 80*b* having a relatively larger inner opening 86*b* diameter. The replacement is a relatively simple service procedure comprised of removing bolts 90*a* and retainer ring 80*a*, installing retainer ring 80*b* in place of ring 80*a* and replacing bolts 90*a***.

The furnace burner assembly 30 utilizing burner plate 70 in longitudinally slideable cooperation with retainer ring 80 and a blower operated by a multiple speed motor 46 provides an inexpensive means for standardizing the components used in a furnace burner assembly 30 while simultaneously providing a simple means for obtaining various selected firing rates in a furance burner assembly 30. This utilization of a standardized sizing of a furnace burner assembly 30 also facilitates a standardization of the furnace heat exchanger assembly 10. Considerable savings in cost and difficulty of manufacture are achieved thereby, with a reduction in the types and inventory of parts which must be manufactured and stocked for the construction and maintenance of a group of furnace heat exchanger assemblies 10.

The multiple speed motor, whether having a plurality of discrete speeds or a range of variably selectable speeds, used in combination with a premix furnace burner assembly 30 provides a relatively inexpensive means of providing a furnace burner capable of rapid response to higher heating requirements, while retaining the ability to operate efficiently in response to lower heating requirements. The use of retainer ring 80 to locationally secure a burner plate 70 while slideably permitting thermal expansion of the burner plate 70 further enhances the durability and expected life of furnace burner assembly 30. This assembly of retainer ring 80 and burner plate 70 also allows for substantial tolerance in the relative dimensions between the mounting base 62, burner plate 70, and retainer ring 80, thus further facilitating ease of manufacture of the furnace burner assembly 30. It will be appreciated, therefore, that the subject invention provides substantial advantages over the known prior art.

Modifications of the subject invention will be apparent to those skilled in the art within the scope of the claims that follow hereinbelow.

I claim:

1. A premix furnace burner comprised of:

a housing defining a premix chamber, said housing having a plurality of apertures therethrough, said apertures defining an air intake for admitting air into said chamber and a gas inlet for admitting combustible gas into said chamber;

a blower impeller disposed rotatably within said housing for mixing said air and said combustible gas into a combustible mixture;

a concave burner plate disposed on said housing, said burner plate having a plurality of burner plate apertures for the passage of said combustible mixture therethrough, said burner plate apertures being substantially small relative to said burner plate;

an annular retainer having an inner annular concave portion in securing longitudinally slideable engagement with said burner plate so as to permit thermal expansion of said burner plate, said retainer further including an outer portion secured to said housing; and a motor having a plurality of speeds driveably connected to said blower impeller for forcing said combustible mixture from said housing through said burner plate apertures.

2. The premix furnace burner as set forth in claim 1 wherein said housing further defines a substantially circular aperture in an end thereof for accepting said burner plate thereover in a sealing manner.

3. The premix furnace burner as set forth in claim 2 wherein said annular ring is further disposed so as to coveringly overlay a portion of said burner plate with said inner annular concave portion, thereby limiting the number of said burner plate apertures available for flow communication from said premix chamber by preventing flow of said gaseous mixture through the burner plate apertures so overlaid.

4. The furnace burner as set forth in claim 3 wherein said motor has a relatively slower first rotational speed and a relatively faster second rotational speed.

5. The furnace burner as set forth in claim 4 wherein said plurality of speeds of said motor further comprises a range of selectable rotational speeds between said first rotational speed and said second rotational speed.

6. A premix furnace burner comprised of:

a housing defining a premix chamber, said housing having a plurality of apertures therethrough, said apertures defining an air intake for admitting air into said chamber and a gas inlet for admitting combustible gas into said chamber, said housing further including a mounting base defining a feed aperture and a plenum;

a blower impeller disposed rotatably within said housing for mixing said air and said combustible gas into a combustible mixture;

a concave burner plate disposed on said housing, said burner plate having a plurality of burner plate apertures for the passage of said combustible mixture therethrough, said burner plate apertures being substantially small relative to said burner plate;

an annular retainer ring having an outer annular planar portion and a concave inner annular portion, said inner portion having an inner aperture of a selected diameter, said inner portion having a surface for engaging a portion of said burner plate to secure said burner plate to said mounting base across and about said feed aperture while coveringly overlaying a selected number of said burner plate apertures in a flow-preventing manner thereby limiting the number of said burner plate apertures available for flow communication of said combustible mixture;

a motor having a plurality of speeds driveably connected to said blower impeller for forcing said combustible mixture from said housing through said burner plate apertures.

7. The premix furnace burner as set forth in claim 6 wherein said premix furnace burner is further comprised of one of at least two selectable replaceable annular retainer rings, each said annular retainer ring having the inner aperture therein of a different diameter from the other said annular retainer ring, whereby the portion of said burner plate coveringly overlaid by said annular retainer ring is a relatively different size for each said annular retainer ring.

8. The premix furnace burner as set forth in claim 6 whererin the motor further comprises an electric motor having a relatively slower first speed and a relatively faster second speed.

9. The premix furnace burner as set forth in claim 6 wherein the motor is further comprised of an electric motor having a range of selectable speeds between said relatively slower first speed and said relatively faster second speed.

10. A method of obtaining a selected firing rate in a premix furnace burner while providing for thermal expansion of a concave burner plate in the furnace burner, comprising the steps of:

mixing air and combustible gas to form a gaseous mixture in a housing defining a premix chamber, said housing further including a blower impeller disposed therein;

operating an electric motor having a range of selectable speeds between said relatively slower first speed and said relatively faster second speed forcing said gaseous mixture through a plurality of burner plate apertures in said burner plate with said blower impeller, said apertures providing flow communication from said premix chamber and further being substantially small relative to the solid burner plate portion; and retaining said burner plate upon said housing in a longitudinally slideable manner with an annular retaining ring, said ring having a concave inner annular portion in partial covering engagement with said burner plate and having an opening communicating co-axially therethrough, said inner annular portion of said retaining ring sized to cover a selected number of said apertures, whereby the number of apertures available for flow of said gaseous mixture is selected.

* * * * *

UNITED STATES PATENT AND TRADEMARK OFFICE

CERTIFICATE OF CORRECTION

PATENT NO. : 4,830,600

DATED : May 16, 1989

INVENTOR(S) : James T. VerShaw and John A. Beasley

It is certified that error appears in the above-identified patent and that said Letters Patent is hereby corrected as shown below:

Column 7, line 9, "hour" should be --Hour--.

Column 8, line 36, "exapnsion" should be --expansion--.

Signed and Sealed this

Nineteenth Day of December, 1989

*Attest:*

JEFFREY M. SAMUELS

*Attesting Officer* *Acting Commissioner of Patents and Trademarks*